US005251743A

United States Patent [19]

Pulido et al.

[11] Patent Number: 5,251,743

[45] Date of Patent: Oct. 12, 1993

[54] REUSABLE UTILITY BAG SYSTEM

[75] Inventors: Annette C. Pulido, 8258 Sugarman Dr., La Jolla, Calif. 92037; Barbara Frank, Avoca, Wis.

[73] Assignee: Annette C. Pulido, La Jolla, Calif.

[21] Appl. No.: 928,503

[22] Filed: Aug. 11, 1992

Related U.S. Application Data

[63] Continuation-in-part of Ser. No. 777,022, Oct. 16, 1991, abandoned, and Ser. No. 688,084, Apr. 10, 1991.

[51] Int. Cl.[5] ..... A45C 11/32

[52] U.S. Cl. ..... 206/38.1; 206/37.1; 383/4; 383/127

[58] Field of Search ..... 206/37.1, 37.4, 37.8, 206/38, 38.1, 554; 224/253, 220; 383/4, 127

[56] References Cited

U.S. PATENT DOCUMENTS

| | | | |
|---|---|---|---|
| 1,119,852 | 12/1914 | McVay | 224/220 |
| 1,252,268 | 1/1918 | Jennings | 2/249 |
| 1,281,229 | 10/1918 | Crosson | 224/253 |
| 1,438,145 | 12/1922 | Swartz | 224/220 |
| 1,571,528 | 2/1926 | Rohr | 206/38.1 |
| 2,297,324 | 9/1942 | Reger . | |
| 3,286,751 | 11/1966 | Dishart | 206/38.1 |
| 3,949,916 | 4/1976 | Yount | 224/253 |
| 4,024,997 | 5/1977 | Kolpin | 224/253 |
| 4,154,323 | 5/1979 | Sneider | 383/4 |
| 4,739,877 | 4/1988 | Olson . | |
| 4,765,037 | 8/1988 | Perry | 224/220 |
| 4,887,751 | 12/1989 | Lehman | 383/4 |
| 4,907,694 | 3/1990 | Miller et al. | 206/38.1 |
| 4,934,528 | 6/1990 | Miller et al. | 206/37.1 |
| 5,009,516 | 4/1991 | Geeck | 383/37 |
| 5,042,649 | 8/1991 | McNutt | 206/38.1 |
| 5,074,439 | 12/1991 | Wilcox | 206/38 |
| 5,082,220 | 1/1992 | Pollock et al. | 224/220 |

FOREIGN PATENT DOCUMENTS

| | | | |
|---|---|---|---|
| 3737120 | 2/1988 | Denmark . | |
| 3727120 | 2/1988 | Fed. Rep. of Germany | 206/38.1 |

*Primary Examiner*—David T. Fidei
*Attorney, Agent, or Firm*—June M. Bostich

[57] ABSTRACT

A convenient reusable utility bag system is disclosed having a multiple purpose reusable and collapsible utility or shopping bag releasably attached by a lanyard to a pocket-sized carrier into which the bag folds for storage when not in use. The bag is designed to fit the grocery assist devices usually used with plastic bags found in many supermarkets. On the exterior of the carrier is a clasp for holding keys, etc.

8 Claims, 3 Drawing Sheets

REUSABLE UTILITY BAG SYSTEM

This patent application is a continuation-in-part of U.S. Pat. application Ser. No. 777,022, filed Oct. 16, 1991, now abandoned and of U.S. Pat. application Ser. No. 688,084, filed Apr. 10, 1991, in their entirety.

BACKGROUND

1. Field of the Invention

This invention relates to carrying devices, specifically to a convenient reusable utility bag system having a containment and carrying apparatus for multiple purpose utility and shopping bags, documents, glasses and other items in combination with apparatuses for carrying keys, pocket knives, tools and other items.

2. Description of the Prior Art

Heretofore, many devices have existed for carrying keys or such items on a clasp device. In some cases, the keys on the clasp device can be temporarily housed within a protective container from which they can be selectively withdrawn as needed for use. In other cases, the clasp device is attached to a container for holding small objects, such as change. But the majority of these devices have served no other purpose and have not served as a functional adjunct to environmentally responsible shopping practices.

Recently, environmental concerns have prompted many consumers to carry their own reusable shopping bags with them, allowing them to refuse wasteful paper and plastic bags from merchants when they make a purchase. One type of reusable shopping or utility bag is of string mesh to make the bags collapsible. However, mesh bags are uncomfortable to carry because they cut into the consumer's hand and cut off the circulation of blood. As shown in U.S. Pat. No. 5,060,998, the string mesh handles of such bags can be fitted into slots in a reusable handle or shopping caddy made of a stiff material such as wood or hard plastic to alleviate the discomfort of carrying mesh bags. But no convenient means for organizing and coordinating the use of the mesh bag and shopping caddy has vet been devised.

Others have made reusable bags of canvas for strength with canvas handles that are easier to carry. However, canvas bags are bulky and do not collapse for storage into a small space. Consequently, these bags are not convenient for the consumer to store and carry for reuse. Moreover, such bags are not generally sized to be used with grocery assist racks commonly used at nationwide supermarket chains. Relatively few consumers take the trouble to actually reuse such inconvenient bags for tasks such as grocery shopping.

Despite these improvements in the art, the need exists for a reusable utility bag system that will further increase consumer convenience and thereby offer further incentives for use of reusable bags, such as shopping bags. Particularly needed is a system including a carrying apparatus for unobtrusively containing one or more light weight, collapsible and reusable shopping bags and/or a shopping caddy. Attached to the carrying apparatus is a device to releasably carry keys, pocket knives, tools or any other similar small items. In areas where consumers travel by automobile, the need is particularly keen for a shopping bag system that helps the consumer keep the keys to the automobile or home conveniently, but safely at hand while transporting purchased goods through the check stand and into the automobile. More particularly, the need exists for a shopping bag system that allows for the reusable shopping bag to be withdrawn from the carrier for use while the carrier and any automobile keys remain releasably attached to the bag, so that the danger of the consumer losing the car keys while shopping is reduced and so that the car keys and carrier can be detached from the bag once the shopping bag is loaded into the automobile.

Because the utility or shopping bag is conveniently concealed within a carrier suitable for placement into a pocket or purse, the user can routinely carry it on his or her person. This convenience eliminates the need to plan ahead for occasions when the bag would be useful. Consequently, the bag of this invention is more likely to be used repeatedly than are less convenient models leading to attendent savings to the environment.

SUMMARY OF THE INVENTION

These objects and more are met by the present invention which provides a carrier comprising a flexible carrier body having an opening for receiving and holding small or collapsible objects with a self-closing device for releasably closing the opening, a clasp attached to the exterior of the carrier for releasably holding small objects, and a lanyard attached to the carrier having at one end of the lanyard a fastener for releasably attaching the lanyard to itself so as to form a holding loop. The carrier forms part of a reusable shopping or utility bag system comprising the carrier, and at least one reusable, lightweight bag releasably tethered to the carrier by the lanyard, wherein the carrier body is sized to contain the bag and the lanyard when the self-closing device is engaged.

DETAILED DESCRIPTION OF THE INVENTION

Figures 1, 2:
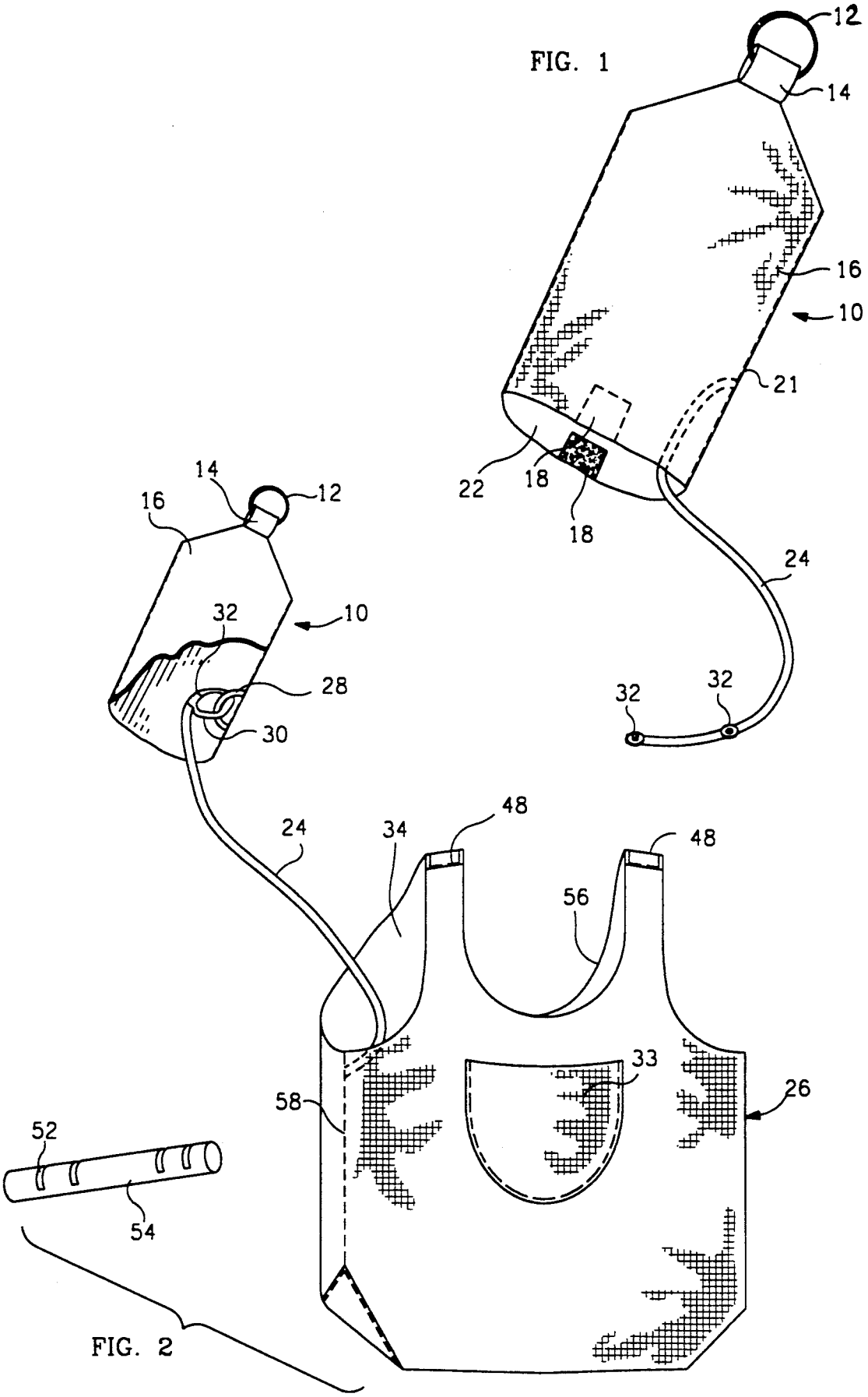
FIG. 1 is a perspective view of the dual purpose carrier having with fixedly attached lanyard for connecting the carrier device to a reusable shopping bag.
FIG. 2 is a cut-away view of the dual purpose carrier having a fixed loop for releasably attaching one end of a, which is fixedly attached at the other end to an unfolded reusable shopping bag.

As shown in FIG. 1, the dual purpose carrier 10 comprises a carrier body 16, clasp 12 for releasable attaching keys or other small objects to the exterior of the carrier body by threading them onto the clasp and fixing it closed, opening 22 for receiving one or more reusable shopping bags and other small objects, such as glasses, a shopping caddy, and the like, a self-closing device 18 for releasably closing opening 22, and lanyard 24, which attaches the carrier body 16 to a reusable utility bag (not shown in this figure).

Carrier body 16 can be made of any material, preferably a flexible one, and can be of any shape, but is preferably elongate and sized to be grasped comfortably by the hand or to be conveniently carried within a handbag, briefcase, backpack, piece of luggage, or large pocket. While the exact size and shape of the carrier body can vary, it must be large enough to contain one or more lightweight, foldable and reusable utility bags, preferably of 70 denier, or "Rip Stop" nylon, such as those shown in FIGS. 2, 4, 5 and 6. Optionally, the carrier body is also large enough to hold a light weight shopping caddy, such as that claimed in U.S. Pat. No. 5,060,998, which is also incorporated herein by reference in its entirety. Most preferably the carrier body is made of a flexible but durable substance such as plastic, leather, canvas, or a durable, water resistant nylon fabric, such as "Oxford" nylon having a denier of 200. The exterior of the carrier body also preferably provides a surface to which can be affixed or upon which can be embossed or imprinted a design or label, such as a decorative or promotional design.

Clasp 12, a device such as is commonly used in key rings for threading and holding keys, small knives, and the like, is attached to the exterior of carrier body 16 by attachment piece 14, which is inserted through the clasp and fixedly attached to the carrier body, such as by sewing it into a seam in the carrier body or by molding it into the carrier body.

Opening 22 is preferably located at an end of carrier body 16 opposite to clasp 12 as shown in FIG. 1. Opening 22 is provided with a self-closing device 18, such as strips of self-adhesive material positioned exactly opposite of each other, to allow for engagement when pressed together or otherwise closed. Alternatively, a snap, a zipper, or any other type of self-adhesive closing device known to those skilled in the art, can be used to close opening 22.

Central to the idea of a reusable shopping bag system is a lanyard for tethering the reusable shopping bag to the carrier body that houses the shopping bag when it is folded up. Lanyard 24 can be made of any flexible, durable material, such as a small chain, fabric or elastic cording, plastic rope, and the like. Lanyard 24 is long enough, that when the shopping bag is withdrawn from the carrier body and unfolded for use, as shown in FIG. 2, the carrier body and any objects, such as car keys, held on clasp 12 can be dropped down into the shopping bag out of sight and be safely held there by the lanyard until it is desired to withdrawn safely held there by the lanyard until it is desired to withdraw it. To accomplish tethering of the carrier to the shopping bag, the lanyard can be either fixedly or releasably attached at each end to connect the carrier to a reusable utility or shopping bag.

Figure 3:
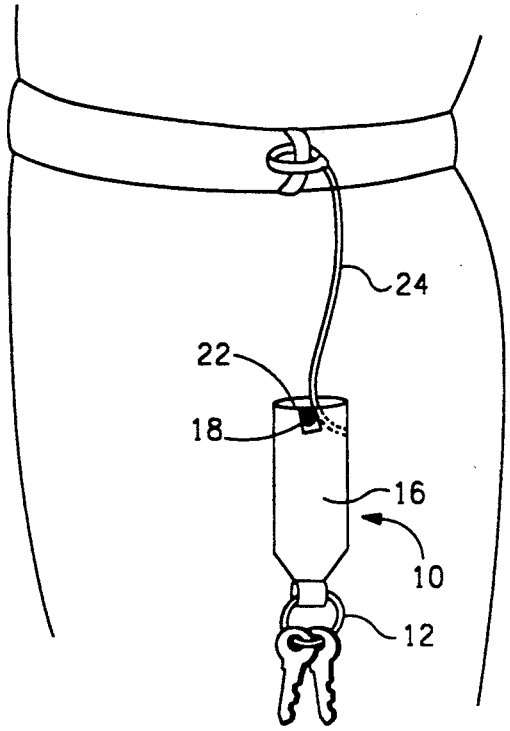
FIG. 3 shows the dual purpose carrier suspended by the fixedly attached lanyard from a belt loop to which it is releasably attached at one end.

In one embodiment lanyard 24 is fixedly attached to carrier body 16 by any suitable means, such as by molding it into the carrier body or by sewing it into an interior seam 21, for instance near opening 22 as shown in FIG. 1. Alternatively, lanyard 24 can be fixedly attached to shopping bag 26, preferably by sewing one end of it into an interior seam, and releasably attached the carrier body 12 as shown in FIG. 2. As shown in FIG. 3, lanyard 24 can also be used to suspend the dual purpose carrier 10 from a belt loop or other similar object for ease of carrying.

As described above, at a point of fixed attachment lanyard 24 can, for example, be molded into or sewn into a seam either in the carrier body or in the reusable shopping bag. For releasable attachment of the lanyard, as shown in FIG. 2, lanyard 24 is threaded through a fixed loop 28, preferably affixed to the interior of either the carrier body or the shopping bag, and releasably attached to itself by means of a fastener such as a snap 32 or by any other suitable means, such as spaced self-adhesive strips attached to lanyard 24 that are brought together to form a releasable loop 30 around fixed loop 28. If the lanyard is releasably attached to the carrier body, it is preferably fixedly attached to the shopping bag by means such as those described above, or if the lanyard is fixedly attached to the carrier body, it is preferably releasably attached to the reusable shopping bag by means such as those described above. Preferably, as shown in FIG. 3, lanyard 24 attaches to the interior of the carrier body and extends through a portion of opening 22 even when self-closing device 18 is engaged so that objects, such as the reusable shopping bag, can be retained within the carrier while the lanyard is used to attach the carrier to another object.

Shopping bag 26, shown in FIG. 2, is constructed of light weight nylon to combine strength and ease of folding. These bags have features that enhance their usefulness to consumers interested in conserving environmental resources without sacrificing convenience. A reversible external pocket 34 is optionally attached to the exterior of bag 26. By turning the pocket inside out, the entire bag can be gathered up and stored in pocket 34.

Figure 4:
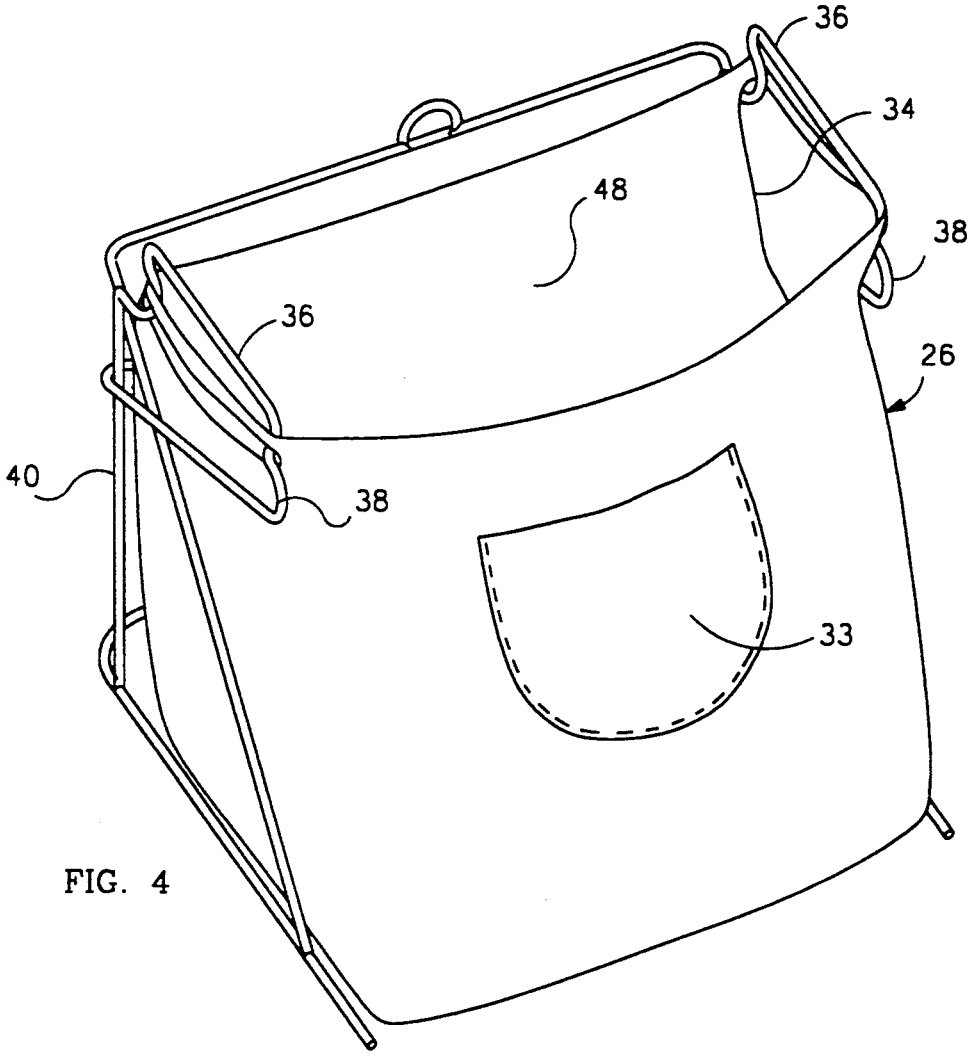
FIG. 4 shows the reusable bag held in one type of grocery assist device.
Figure 5:
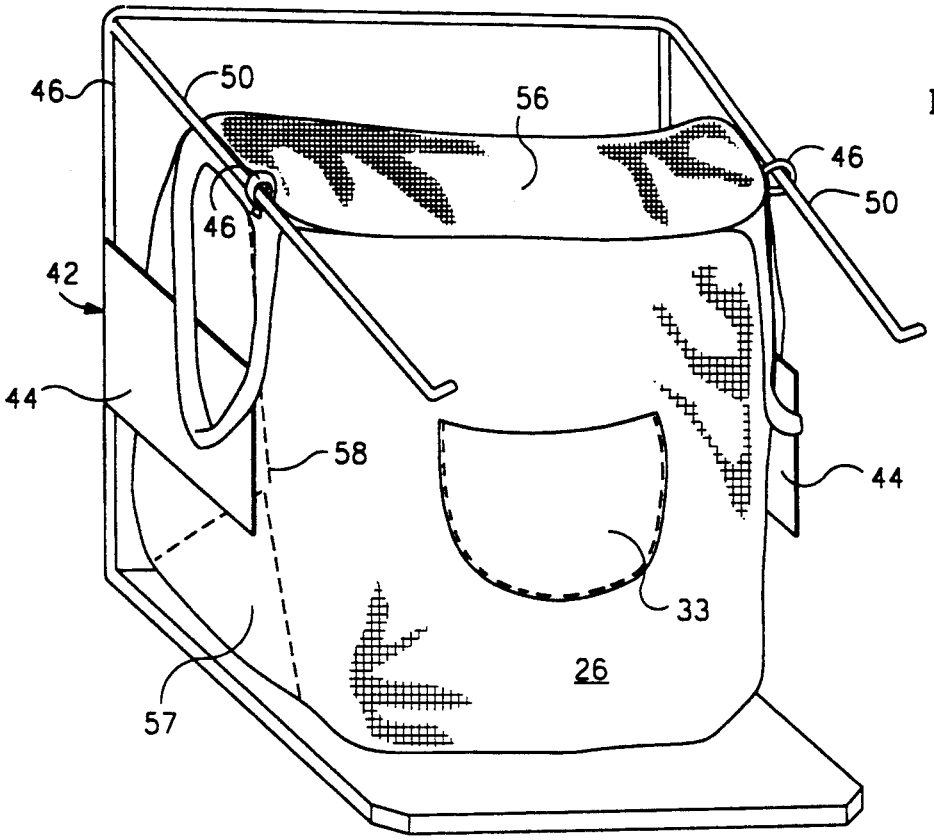
FIG. 5 shows the reusable bag held in another type of grocery assist device.

In the preferred embodiment the shopping bag is preferably designed and sized to be supported in an upright, open attitude by the rigid arms that extend from the frame of a grocery assist rack, commonly known as "a plastic bag rack holder," such as is presently used in nationwide supermarket chains. There are two basic types of grocery assist devices in use today. As shown in FIG. 4, one type utilizes supporting arms with stepped portions over which the handles of a grocery bag are stretched to hold the bag in an open, upright attitude while it is filled. For use with this type of grocery assist device, shopping bag 26 is provided with armholes 34 dimensioned to fit tautly around stepped portions 36 on the supporting arms 38 of grocery assist device 40. Generally, the armholes will measure between about ten and five inches when stretched tautly by placing two fingers inside the armhole and moving them apart to stretch the armhole as far as possible, i.e., until the armhold collapses to form two parallel sides. In the open position the armhole will therefore have a circumference of between about 20 and 10 inches. As shown in FIG. 5, a second type of grocery assist device 42 utilizes straight, rigid arms 50 from which the grocery bag is suspended for filling. Side panels 44 extending from the frame 46 of the grocery assist device 42 help to localize and stabilize the suspended grocery bag. For use with this second type of grocery assist device, shopping bag 26 can also be provided with internal loops 46 having a circumference of between about five and three inches fixedly attached at opposite sides near the top opening 56 of bag 26. For instance, loops 46 can be sewn or otherwise affixed into side seams 58 of bag 26. Loops 46 are located such that bag 26 hangs from supporting arms 50 within the confines of side panels 44.

As also illustrated in FIG. 2, shopping bag 26 is also preferably provided with reinforced handle regions 48 located at the top of armholes 34, which handle regions are optionally sized to fit into slots 52 in a rigid carrying handle or shopping caddy 54, such as that disclosed in U.S. Pat. No. 5,060,998 mentioned above. The reinforced handle regions can be fashioned by folding together and sewing or otherwise securing, for instance by gluing, or melting the material forming the handle at the top of the armhole to form a compact, narrow region that fits comfortably into the palm of the hand. Thus the length of the handle region is about four or five inches and the width of the handle region is about one inch.

Figure 6:
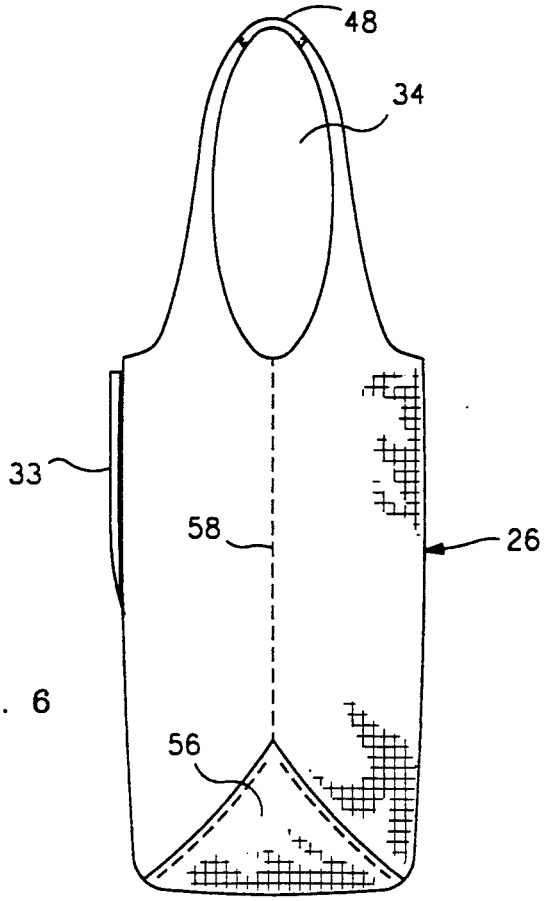
FIG. 6 shows a side view of a reusable bag having squared gussets.

As shown in FIG. 6, in side view, the bottom of bag 26 is preferably constructed with squared gussets 56 located in vertical alignment with armholes 34 so as to provide bag 26 a bottom surface having squared corners, such that the bottom surface of bag 26 (not shown) forms a rectangular or square surface. Squared gussets 56 can be formed by folding the material from which the bottom of bag 26 is constructed along each side seam 58 to form an isosceles triangle that is symmetrically attached to each side seam 58 so that the point of the triangle points at the lowest point of armhole 34 and the base of the triangle is perpendicular to the side seam 58. One skilled in the art can devise alternate means of fashioning bag 26 so as to provide a bottom surface with squared corners, for instance such as is found in many paper bags.

In use, objects such as keys, knives, and tools are threaded on or attached to the clasp on the exterior of the carrier body. Reusable shopping bags, a shopping caddy, glasses, documents, cigarettes drivers license, credit cards, and like objects are inserted into the carrier body and the self-closing device is secured to retain the enclosed objects. The reusable shopping bag can be held within the carrier, or can be withdrawn and unfolded for use, yet releasably attached to the carrier, by means of the lanyard. Alternatively, the lanyard, can be used to releasably attach the carrier, while optionally retaining some or all of the objects stored within, to any other object having a fixed loop, such as a belt loop, or any similar feature about which the lanyard can be self-attached.

Thus, in the preferred embodiment, the reusable shopping bag system provides the consumer with a convenient system for conveniently retaining car keys while storing one or more collapsible, lightweight reusable shopping bags and, optionally, a shopping caddy or any of the above-named items. Moreover, the lanyard substantially enhances the convenience of the system by providing a means to safely store the carrier and attached car keys within the shopping bag when the shopping bag and/or shopping caddy has been withdrawn from the carrier for use and filled with purchases. Once the consumer has transported the shopping bag and purchases to the automobile, the carrier and car keys can be released from the lanyard, and withdrawn from the shopping bag to make the car keys accessible for use.

While the above description contains many specificities, these should not be construed as limitations on the scope of the invention, but rather as an exemplification of one preferred embodiment thereof. Many other variations are possible. For example, the clasp can be round, square or oblong, made of plastic, metal or fiber the carrier body can be made of a variety of fabrics and in several shapes; and the attachment piece can be made of a variety of materials and shapes. Sizes can be altered somewhat as long as the overall size remains convenient.

Accordingly, the scope of the invention should be determined not by the embodiment(s) illustrated, but by the appended claims and their legal equivalents.

We claim:

1. A shopping bag system comprising:

(a) A carrier comprising:

(1) a flexible carrier body having an opening with a self-closing device for releasably closing said opening for receiving and holding objects;

(2) a clasp attached to the exterior of the carrier body for releasably holding small objects threaded onto the clasp; and (3) a lanyard being attached to the carrier body near said opening and having at the proximal end a fastener for releasably attaching the lanyard to itself so as to form a holding loop; and (b) at least one lightweight, foldable, reusable bag releasably tethered to the carrier by the lanyard; wherein the carrier body is sized to contain the bag and lanyard when the self-closing device is engaged;

wherein the lanyard is releasably attached at the proximal end to the interior of the carrier by passing it through a fixed loop in the interior of the carrier and closing a fastener on the lanyard around the fixed loop and the lanyard is fixedly attached at the distal end to the interior of the bag.

2. The system of claim 1 wherein the fastener on the lanyard is made of strips of self-adhesive material spaced at the proximal end of the lanyard.

3. The system of claim 1 wherein the fastener on the lanyard is a snap with adjoining halves spaced at the proximal end of the lanyard and the self-closing device on the carrier is a snap.

4. The system of claim 2 wherein the carrier is made of durable, water resistant nylon or leather, and the bag is made of lightweight nylon.

5. The system of claim 1 wherein the bag comprises means for grasping and carrying the bag suspended from the hand.

6. The system of claim 4 wherein the bag comprises an exterior pocket.

7. The system of claim 1, 2 or 3 wherein the bag comprises armholes having a circumference of between about 20 and 10 inches at opposite sides of the opening of the bag, said armholes having reinforced regions of between about 6 and 4 inches in length positioned vertically opposite the bottom of the bag to provide a means for grasping and carrying the bag in the hand and wherein the bottom of the bag is fashioned with squared corners, and further wherein the size of the bag and the armholes is selected such that the armholes fit tautly around stepped portions of the supporting arms of a grocery assist device while the bag assumes an upright, open attitude when said armholes are so engaged with said arms.

8. The system of claim 7 for use with grocery assist devices having straight, rigid arms from which a grocery bag hangs suspended wherein the bag further comprises loops affixed to opposite sides near the opening of the bag, said loops being sized and located along the sides of the bag for suspending the bag therefrom in an upright, open attitude when said loops are threaded upon said arms and wherein the bag further comprises squared gussets for shaping the squared corners.

* * * * *